United States Patent [19]

Wagner et al.

[11] Patent Number: 4,632,216

[45] Date of Patent: Dec. 30, 1986

[54] MUFFLER APPARATUS AND METHOD FOR MAKING SAME

[75] Inventors: Wayne M. Wagner; Timothy A. Bethke, both of Apple Valley; Steven D. Schmeichel, Inver Grove Heights, all of Minn.

[73] Assignee: Donaldson Company, Inc., Minneapolis, Minn.

[21] Appl. No.: 624,935

[22] Filed: Jun. 27, 1984

[51] Int. Cl.[4] ..... F01N 1/08

[52] U.S. Cl. ..... 181/255; 181/265; 181/272

[58] Field of Search ..... 181/248–252, 181/253, 259, 255, 231, 272, 264, 281, 265

[56] References Cited

U.S. PATENT DOCUMENTS

| | | | |
|---|---|---|---|
| 910,192 | 1/1909 | Grouvelle et al. . | |
| 1,342,340 | 6/1920 | Martin . | |
| 1,835,340 | 12/1931 | Huby . | |
| 2,233,327 | 2/1941 | Sauer . | |
| 2,391,863 | 1/1946 | Bowen . | |
| 3,043,097 | 7/1962 | Inman et al. . | |
| 3,104,736 | 9/1963 | Ludlow et al. . | |
| 3,419,892 | 12/1968 | Wagner et al. | 181/259 X |
| 3,672,464 | 6/1972 | Rowley et al. | 181/253 |
| 3,702,144 | 11/1972 | Loveland . | |
| 3,857,458 | 12/1974 | Ohtani et al. . | |
| 4,064,962 | 12/1977 | Hunt . | |
| 4,113,051 | 9/1978 | Moller | 181/231 |
| 4,142,606 | 4/1979 | Vanderzanden et al. | 181/231 |
| 4,143,739 | 3/1979 | Nordlie . | |
| 4,147,230 | 4/1979 | Ormond et al. | 181/231 |
| 4,267,899 | 5/1981 | Wagner et al. | 181/272 |
| 4,296,832 | 10/1981 | Kicinski . | |
| 4,325,460 | 4/1982 | Hoppenstedt | 181/259 |
| 4,361,206 | 11/1982 | Tsai | 181/255 |
| 4,368,799 | 1/1983 | Wagner | 181/255 |

*Primary Examiner*—Benjamin R. Fuller

*Attorney, Agent, or Firm*—Merchant, Gould, Smith, Edell, Welter & Schmidt

[57] ABSTRACT

The present invention is directed to muffler apparatus and a method for making same. The apparatus includes inlet and outlet tubes with a plurality of baffles extending from the inlet and outlet tubes to a housing. The outlet tube has a constricted portion near its inlet end formed with creases and lobes and a flare at the end. Such constriction increases the housing to outlet tube area ratio of the muffler which results in advantageous attenuation characteristics. The process for making the muffler is simpler than known methods since the outlet tube is formed and baffles pressed onto it in a single step.

8 Claims, 14 Drawing Figures

MUFFLER APPARATUS AND METHOD FOR MAKING SAME

TECHNICAL FIELD

The present invention relates to the structure of tube elements used as parts of sound suppression devices, such as mufflers and exhaust ejectors. The invention also relates to the method for making the tube elements.

BACKGROUND OF THE INVENTION

Numerous types of mufflers having various parts and elements for sound suppression or attenuation are known. Nevertheless, slight changes in configuration of elements cause different interference patterns of sound waves of the same and different frequencies. Thus, the art continues to develop since better or approximately equivalent sound suppression results may be obtained with assembly configurations somewhat different from or processes less costly than previous configurations or processes. It is in this sense that the present invention assumes significance relative to the art, and, in this regard, the discussion hereinafter traces improvements in muffler apparatus to show the significance of the present invention.

Rowley (U.S. Pat. No. 3,672,464) shows a muffler having aligned input and output tubes within a housing. A plurality of baffles extends between the tubes and a housing. The output tube is formed to converge from a cylindrical shape to a throat before expanding rapidly outwardly to approximately the earlier indicated cylindrical shape as the output tube is viewed from downstream to upstream. Wagner (U.S. Pat. No. 4,267,899) shows variations on the design to include an offsetting alignment between input and output tubes. Wagner (U.S. Pat. No. 4,368,799) shows further variations which include throat portions in both the input and output tubes. In addition, the mufflers shown in each of these patents include a cylindrical tube encircling the converging and throat portions of the tubes. Thus, it is clear that the manufacturing process requires a forming step, as well as a step for pressing one tube into the other, and a step for pressing on baffles, each step of course adding to manufacturing costs.

Schmeichel (Ser. No. 505,424, filed June 16, 1983, and assigned to the same assignee as the previously mentioned patents) discloses muffler apparatus also having aligned input and output tubes with a converging portion and a throat portion in the output tube. Schmeichel, however, found advantage in forming the converging and throat portion of the output tube to include a plurality of bypass passages which were not constricted. Although such an output tube accomplishes advantageous sound suppression results, it requires the manufacture of the specially shaped tube. For use in a muffler, baffles are then thereafter pressed onto the tube.

The present invention achieves the sound suppression results of the art, but does so with a much more simply manufactured apparatus and, consequently, is less costly.

SUMMARY OF THE INVENTION

The present invention is directed to sound suppression apparatus which includes a housing with inlet and outlet tubes. One of the inlet and outlet tubes, however, has a constant perimeter from one end to the other but at one end portion has an inwardly extending crease which mates with a flare at the end of the tube.

More particularly, the present invention includes an embodiment having an outlet tube which is constricted toward its inlet end to include at least one crease which expands into a flare at the inlet end. The outlet tube also includes a perforated portion which may be located along the creased portion of the tube. Furthermore, a baffle extending between the outlet tube and a housing may be located along the creased portion.

A muffler including a tube having the indicated configuration, and particularly when the configuration is near the inlet end of the outlet tube, surprisingly results in sound suppression characteristics approximately equivalent with or even better than tubes of much greater shape complexity as described with respect to the art. In this regard, it is noted that the flared inlet end functions to reduce back pressure. Furthermore, the creased portion not only creates a throat which provides a venturi function, but also does so in a fashion which maintains the constant perimeter of the outlet tube which thereby necessarily on creation of the creased portion and throat enlarges the surrounding expansion chamber's effective volume. All such features advantageously combine to enhance sound suppression.

Of equal importance, the advantageous shape of the indicated tube may be obtained by a process which combines assembly of one or more baffles to the tube. In this way, assembly steps are reduced which naturally results in considerable cost savings. Thus, many of the advantages of the art are obtained with a rather simple configuration which is easily achieved during manufacture and, consequently, results in a rather inexpensive, yet equivalently effective suppression device.

These advantages and other objects obtained by this invention are explained further hereinafter and may be better understood by reference to the drawings and descriptive matter presented. The drawings show a preferred embodiment of the apparatus and method of manufacture, and the inventive apparatus and process is described in detail relative thereto.

DETAILED DESCRIPTION OF THE INVENTION

Figure 1:
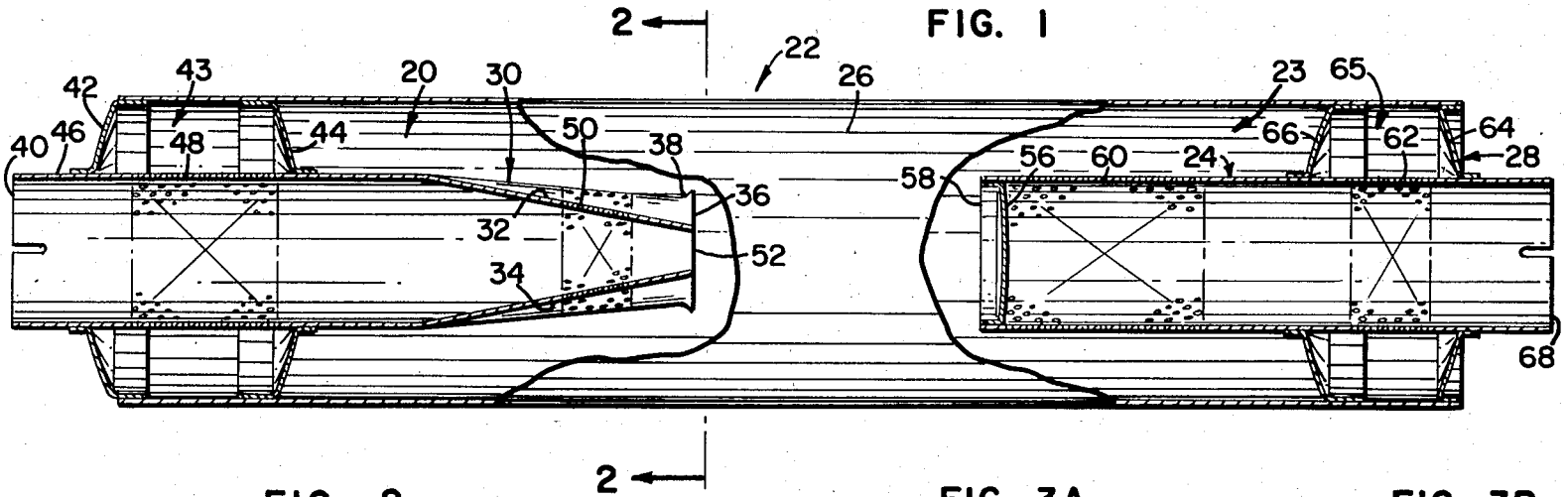
FIG. 1 shows an elevational view, in partial cross section, of a muffler assembly including apparatus in accordance with the present invention.

Referring now to the drawings wherein like reference numerals designate identical or corresponding parts throughout the several views, and more particularly to FIG. 1, constricted tube apparatus in accordance with the present invention is designated generally by the numeral 20. Constricted tube 20 as used in muffler 22 of FIG. 1 is an outlet tube. Muffler 22 has an inlet tube 24 aligned with tube 20. Inlet and outlet tubes 24, 20 are attached to housing 26 with a plurality of baffles generally designated 28.

Figure 2:
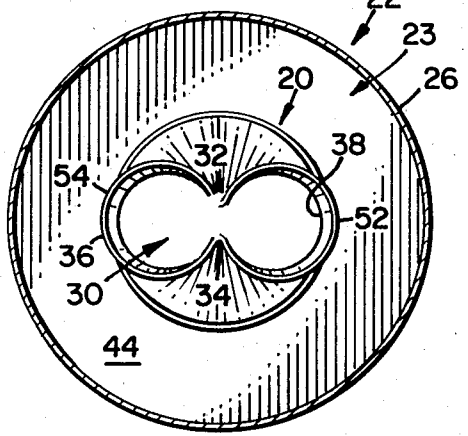
FIG. 2 shows a cross-sectional view taken along line 2—2 of FIG. 1.

As shown in FIGS. 1 and 2, tube 20 includes a constricted segment or portion 30 formed with inclined creases 32 and 34. Tube 20 has a flare 36 at its inlet end which conforms with constricted portion 30 at a throat 38.

Proceeding from left to right in FIG. 1, tube 20 has an outlet end 40. Tube 20 has a cylindrical portion 46 between outlet end 40 and constricted portion 30. A pair of baffles 42 and 44 are spaced apart and are fastened in a conventional fashion to the cylindrical portion 46 of tube 20. Cylindrical portion 46 includes a perforated portion 48 between baffles 42 and 44 to create a final attenuation chamber 43 for sound reduction.

Constricted portion 30 may also include a perforated portion 50 as shown. Constricted portion 30 has its greatest constriction at throat 38 where it mates with and increases in size to form flared end 36 of tube 20. It is noted that, as shown in FIG. 2, a portion of the lobes 52 and 54 of constricted portion 30 may extend beyond the original cylindrical profile of tube 20. Nevertheless, the perimeter of tube 20 is approximately constant at any particular location between inlet and outlet ends 36 and 40.

Inlet tube 24 has a solid wall 56 at its outlet end 58. Inlet tube 24 includes a perforated portion 60 adjacent to wall 56. Inlet tube 24 further includes a perforated portion 62 between baffles 64 and 66 which extend between tube 24 and housing 26.

In use, exhaust gas enters muffler 22 at inlet end 68 of inlet tube 24. The exhaust gas may expand through perforated portion 62 into a first attenuation chamber 65 between baffles 64 and 66 and housing 26. As the exhaust gases continue along inlet tube 24, they expand into the primary expansion chamber 23 through perforated portion 60. Wall 56 prevents the exhaust gases from proceeding directly from inlet tube 24 to outlet tube 20. From primary expansion chamber 23, the exhaust gases proceed toward outlet tube 20 and may enter at flared end 36 or perforated portion 50. Flare 36 helps to minimize back pressure by receiving a larger portion of exhaust gases than would otherwise be the case. Throat 38 functions as a venturi to speed the flow of the exhaust gases so as to aspirate gases through perforated portion 50 into outlet tube 20. A final attenuation chamber 43 is located between baffles 42 and 44 and housing 26 so that gases may expand into it from perforated portion 48 before proceeding to outlet end 40.

Figure 3B:
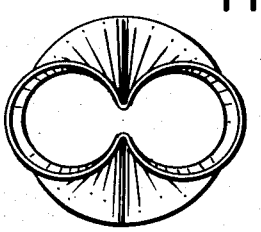
FIGS. 3A–3D are views similar to FIG. 2 showing a variety of shapes for a creased tube in accordance with the present invention.
Figure 3D:
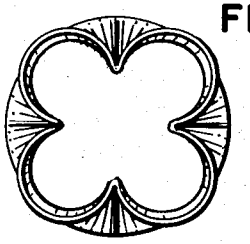
Figure 3A:
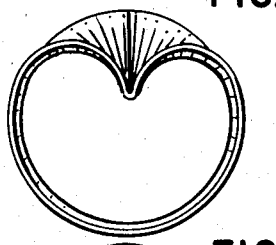
Figure 3C:
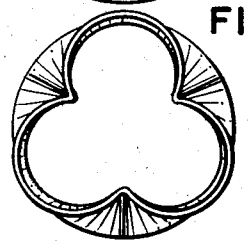

The primary silencing or noise attenuating factor in muffler design is the area ratio of the muffler housing cross section to the tube cross section. A typical area ratio for truck mufflers is four to one, resulting from a typical 10 inch diameter housing and a 5 inch diameter outlet tube. The outlet tube of the present invention is reformed for a significant portion of its length into a shape which increases its perimeter to area ratio and which also increases the housing to outlet tube area ratio. Basic shapes that reduce effective cross-sectional area of the outlet tube and improve the indicated ratios include the one sided crease (see FIG. 3A), the figure eight (see FIG. 3B), the clover leaf (see FIG. 3C), and the four-way (see FIG. 3D).

The reformed tube also results in increased volume of the primary expansion chamber, which is a derivative benefit yet a significant feature with respect to ultimate sound attenuation. Another benefit of the reduced effective area of the outlet tube is that the cut off frequency of the muffler is increased, since cut off frequency is inversely proportional to effective tube diameter. As a consequence, the muffler is effective for an increased range of frequencies. In addition, the reformed tube increases exhaust gas velocity with the throat and gradual expansion of the tube and offsets back pressure with the flared tube entrance. Thus, acoustic benefits from the reformed tube 20 of the present invention are many, especially in view of the fact that the tube is easily and inexpensively reformed, as described hereinafter.

Figure 4:
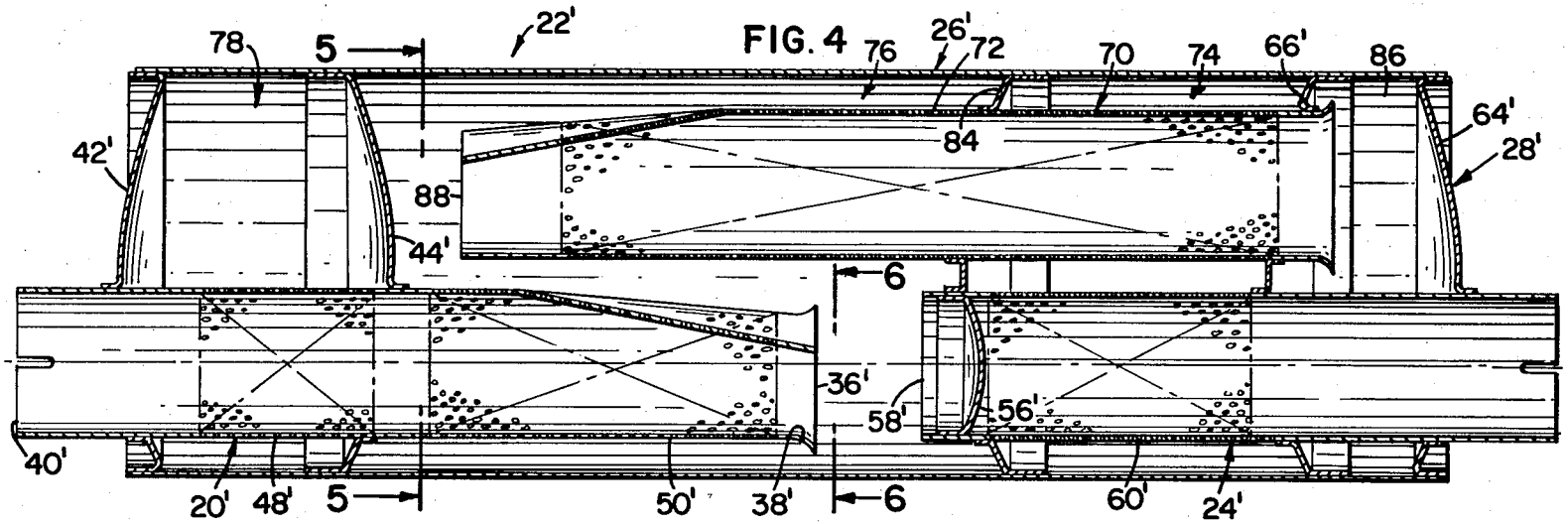
FIG. 4 shows muffler apparatus in an elevational cross section view wherein an offset tube is inclined between input and output tubes such that the offset tube also has structure in accordance with the present invention.
Figure 6:
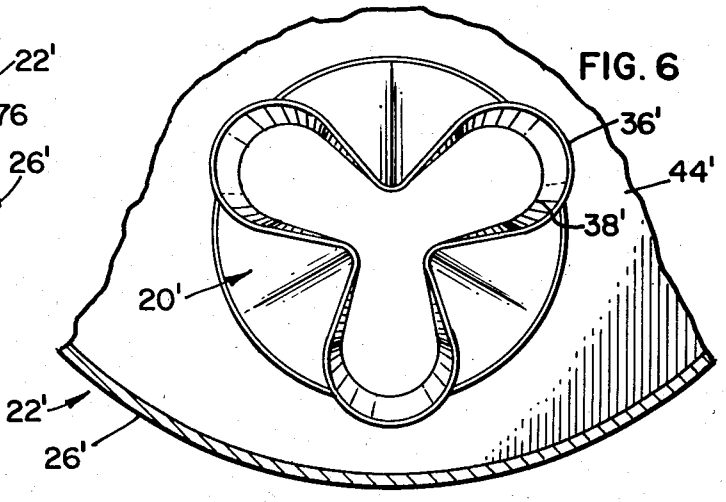
FIG. 6 is a cross-sectional view taken along line 6—6 of FIG. 4.
Figure 5:
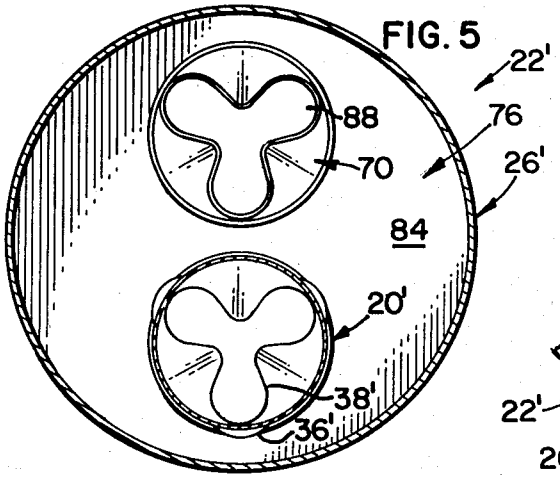
FIG. 5 is a cross-sectional view taken along line 5—5 of FIG. 4.

An alternate muffler embodiment is shown in FIGS. 4–6. Equivalent elements are identified by the same numbers as the embodiment of FIGS. 1 and 2, except the numbers are primed. Muffler 22′ includes a housing 26′ having an inlet tube 24′ and an outlet tube 20′. Muffler 22′ further includes a transfer tube 70. Inlet tube 24′, transfer tube 70 and outlet tube 20′ are supported within housing 26′ by a plurality of baffles 28′. Inlet tube 24′ includes a perforated portion 60′ and an end wall 56′ near the outlet end 58′. Transfer tube 70 includes a perforated portion 72. Outlet tube 20′ includes perforated portions 50′ and 48′. Muffler 22′ includes expansion chambers 74, 76, 78, and 86 with openings (not shown) in baffle 66′ providing communication between expansion chambers 74 and 86. Exhaust gases pass through muffler 22′ by entering inlet tube 24′ and expanding through perforated portion 60′ into expansion chamber 74. Gases either flow through openings in baffle 66′ to expansion chamber 86 to enter the flared entrance of tube 70 in chamber 86 or enter transfer tube 70 perforated portion 72. Exhaust gases in transfer tube 70 flow through the perforated portion 72 into expansion chamber 76 or may flow out the outlet end 88. In any case, the exhaust gases then enter outlet tube 20′ either at flared end 36′ or through perforated portion 50′. Some of the exhaust gases in outlet tube 20′ are further sound attenuated by communicating through perforated portion 48′ into chamber 78 before all exhaust gases exit muffler 22′ at outlet end 40′.

Muffler 22′ has constricted portions at the inlet end portion of outlet tube 20′ and at the outlet end portion of transfer tube 70. Thus, it is understood that the constricted portions may be located on tubes other than the outlet tube and at ends other than the inlet end. The constrictions have a clover leaf shape as shown in FIG. 5 which is similar to the example of FIG. 3C. The constrictions increase the area ratio of muffler 22' and increase the effective volume of expansion chamber 76. Flared end 36' of outlet tube 20' is shown in FIG. 6, and as described hereinbefore, functions to reduce back pressure within muffler 22'. The throat 38 is seen as the innermost perimeter of outlet tube 20'.

Figure 8:
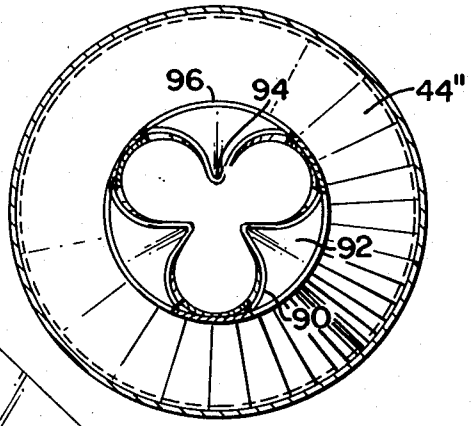
FIG. 8 is a cross-sectional view taken along line 8—8 of FIG. 7.
Figure 7:
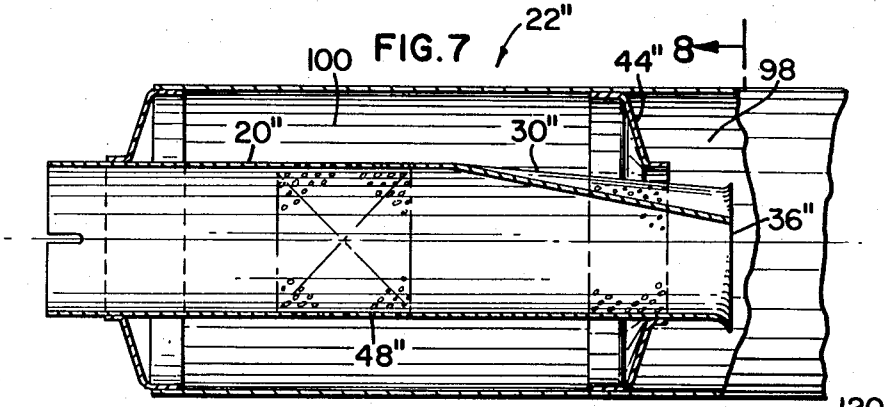
FIG. 7 is an alternate embodiment shown in partial cross section of a portion of muffler apparatus like that of FIG. 1.

Yet another embodiment of a muffler designated as 22" is shown in FIGS. 7 and 8. Muffler 22" shows baffle 44" fastened to the lobes 90 of constricted portion 30" of outlet tube 20". Such a placement of baffle 44" provides for open spaces 92 between the creased perimeter 94 of outlet tube 20" and the circular inside diameter 96 of baffle 44". In this way, exhaust gases may pass from expansion chamber 98 to expansion chamber 100 either through openings 92 or through outlet tube 20" by entering at flared end 36" and expanding through perforated portion 48".

Figure 9:
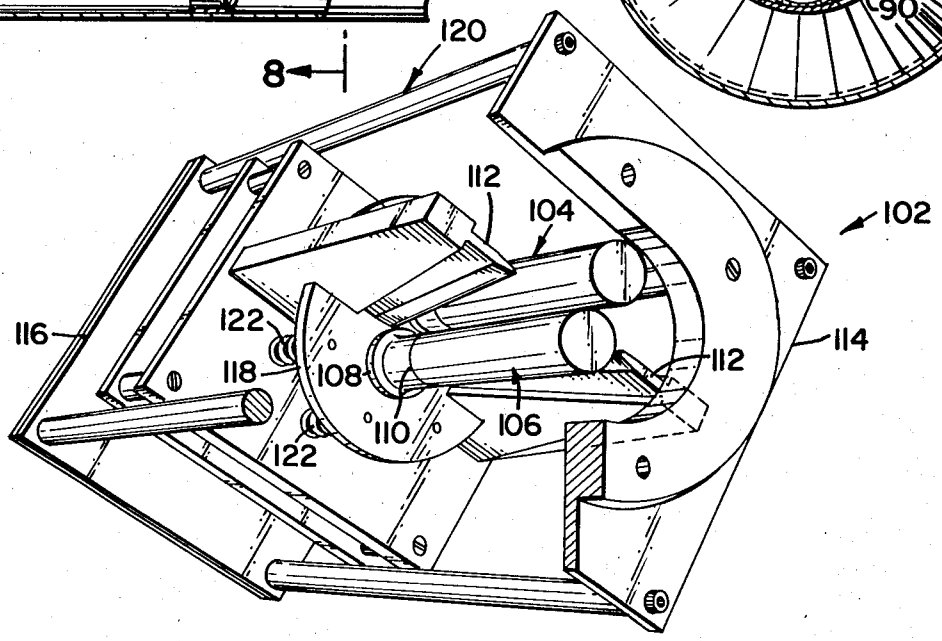
FIG. 9 is a perspective view of a tool representative of a type useful to form a tube for muffler apparatus in accordance with the present invention.

The process for forming the creased constricted portion of one or more of the tubes for use in sound suppression apparatus in accordance with this invention is also novel. A tool 102 useful for forming a constricted tube 20 is shown in FIG. 9. The tool 102 of FIG. 9 could be used as described hereinafter to create a figure eight constriction similar to that shown in FIG. 3B or a similar tool could be used to form other configurations, for example, those shown in FIGS. 3A–3D. Tool 102 includes a pair of mandrels 104 having a shape or diameter equivalent to the inside diameter of a lobe of, for example, tube 20. Mandrels 104 have straight end portions 106 and 108 which meet at circumferential cut 110. End portion 108 expands at its lowermost end so as to form flared end 36 for tube 20.

The axes of mandrels 104 define a first plane. Knife blades 112 are centered on a second plane which is perpendicular to the first plane and centered between the axes of mandrels 104. Knife blades 112 are blunted so as not to cut tube 20, while yet forming an appropriate creased indentation as tube 20 is axially pressed into knife blades 112. Knife blades 112 converge from the entry end 114 of tool 102 toward the far end 116. The degree of convergence and the separation of the blades from one another and from mandrels 104 determine the length and the degree of constriction of the constricted portion 30.

The intersection of the first and second planes of tool 102 described above defines the axis of tool 102. As a tube, for example 220 (see FIG. 10), is pressed onto tool 102, the axis of tool 102 and tube 220 is common to both. Mandrels 104, whether two or more, are equally spaced from the axis of tool 102, and the plates forming knife blades 112 are located on radial planes with respect to the axis of tool 102. The blades extend, at best partially, into the circumference of tube 220. With such apparatus as described in more detail hereinafter, the pressing of tube 220 onto tool 102 forms the constricted portion to have lobes equally spaced from the axis of tool 102 with the creases directed at the axis of the tube 220.

Tool 102 includes a yieldable base 118 with respect to frame 120. In this way, when a tube 20 is formed, base 118 may yield and mandrels 104 may separate at line 110 so that when the pressing force on the formed tube is relieved, compressed springs 122 may force the formed tube off the cylindrical portions 106 of mandrels 104.

Figure 10:
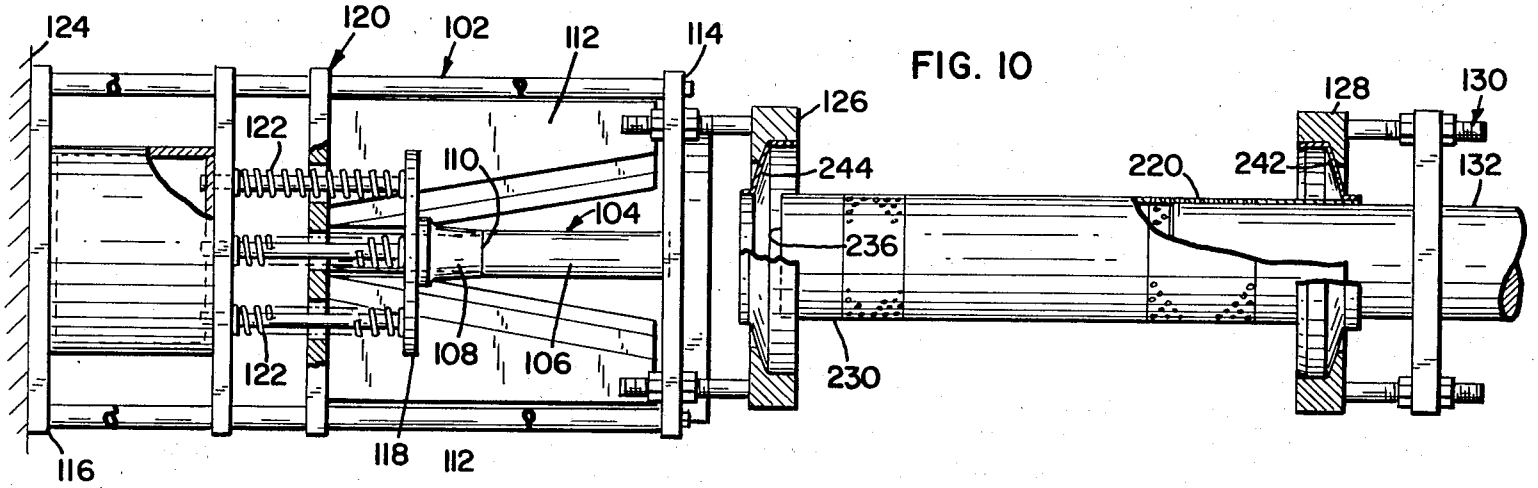
FIG. 10 shows the tool of FIG. 9 in side elevation in combination with pressing apparatus before a tube of the present invention is formed.
Figure 11:
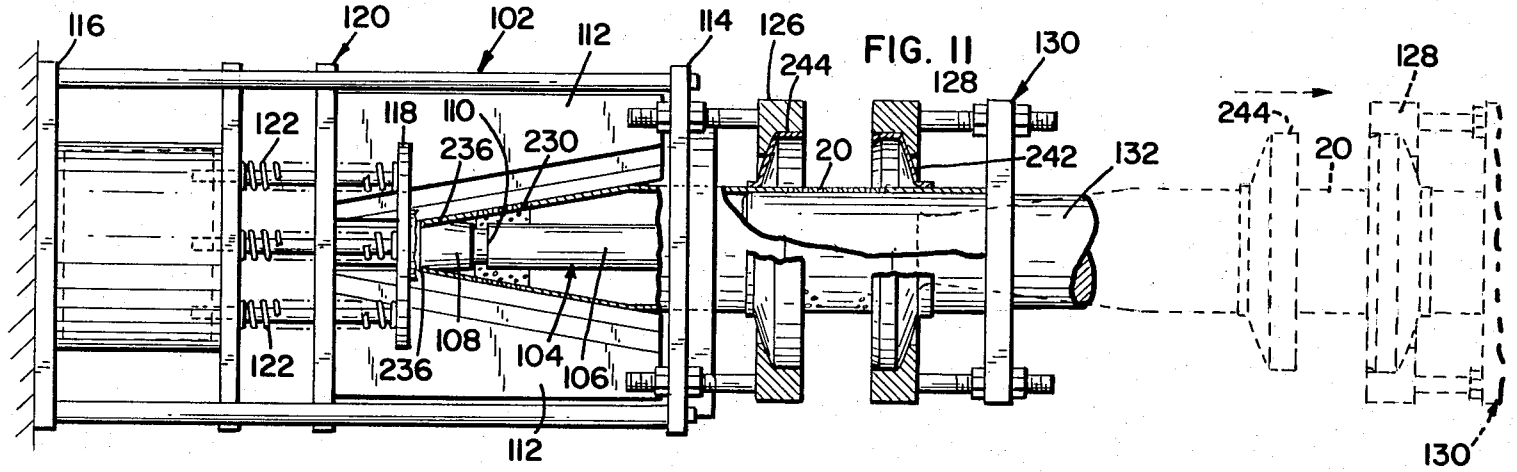
FIG. 11 is similar to FIG. 10 except the pressing apparatus has been moved to form the tube and locate the baffles on the tube, with phantom lines showing the tube and baffles when removed from the forming tool.

The process of forming a tube is illustrated in FIGS. 10 and 11. Tool 102 is attached to a fixed structure 124. A holding assembly 126 is attached to end 114 of tool 102. Holding assembly 126 supports a baffle, like 244. A second holding assembly 128 is attached to press structure 130. Second holding assembly 128 supports a baffle 242. A tube 220 is placed between baffles 244 and 242. The press (not shown) is then functioned to engage tube 220 at the contact point between tube 220 and baffle 242 and at mandrel 132 partially within tube 220. The press is then further functioned to press first and second baffles 242 and 244 onto tube 220. At the same time, tube 220 is forced into tool 102 such that knife blades 112 crease portion 230 and flare end 236, as shown in FIG. 11. When tube 220 has been forced to the ends of mandrels 104, the press apparatus is reversed so that further pressing force is relieved. Springs 122, compressed as tube 220 was forced to the end of mandrels 104, extend and force tube 220 from mandrels 104 so that tube 220 may be removed from tool 102 as shown in the phantom lines of FIG. 11.

A muffler apparatus, like 22, is then completed by using a similar pressing operation without a forming tool 104 to press third and fourth baffles onto an inlet tube, like 24. Inlet and outlet tubes, like 24 and 22, are then pressed into a housing, like 26. At least the end baffles are then welded or otherwise fastened to complete muffler 22.

The present process is particularly advantageous since it eliminates at least one step which is needed in prior art processes. Prior art processes require a forming of the outlet tube before baffles can be pressed onto the tube. Because the present process forms the outlet tube using an axial press, baffles may be simultaneously pressed onto the tube as it is pushed axially into the forming tool. The axial pressing step and the simple forming of a constant perimeter tube, thus, eliminates separate tube forming and baffle pressing steps.

As indicated hereinbefore, a number of embodiments have been discussed and advantages pointed out. Details of structure and function of the various embodiments, including the new process, have been described. The advantages and details, however, are representative of the concept and are, therefore illustrative. Consequently, changes made, especially in matters of shape, size, arrangement, and combinations of known elements and assemblies, to the full extent extended by the general meaning of the terms in which the appended claims are expressed, are understood to be within the principle of the present invention.

What is claimed is:

1. A muffler, comprising:

a housing having an endlessly curving wall, said housing also having opposite end baffles and first and second intermediate baffles attached to said wall, said wall and said intermediate baffles forming an expansion chamber;

an inlet tube attached to one of said end baffles and said first intermediate baffle, said inlet tube having inlet and outlet ends, said inlet tube including a closure at the outlet end and means upstream from the outlet end for communicating gaseous fluid to said expansion chamber; and an outlet tube attached to one of said end baffles and said second intermediate baffle, said outlet tube having inlet and outlet ends, said inlet end including shape means for increasing sound attenuation of gaseous fluids entering said outlet tube and reducing volume occupied by said outlet tube thereby increasing expansion chamber volume to further enhance sound attenuation within said expansion chamber, said shape means of said outlet tube including a plurality of connected, partial ovals proceeding from a circular cross-sectional shape near said outlet end along a constricted portion to a throat cross-sectional area which connects with a flared portion leading to the inlet end of said outlet tube.

2. The muffler in accordance with claim 1 wherein said constricted portion includes a perforated portion and said second intermediate baffle extends between said housing and the perforated portion of said constricted portion, said baffle and said outlet tube forming spaces therebetween in regions between said ovals.

3. A muffler, comprising:

a housing having an endlessly curving wall with opposite ends;

a plurality of fluid communication tubes;

a plurality of baffles including first and second end baffles attached to said housing with one at each of the opposite ends of the wall of said housing, said plurality also including between said end baffles first and second intermediate baffles attached to said housing and forming an expansion chamber therebetween; and a first of said tubes being attached to said first end baffle and to said first intermediate baffle and having an inlet on a side of said first end baffle opposite from said first intermediate baffle, a second of said tubes being attached to the other of said end baffles and to said second intermediate baffle and having an outlet on a side of said second end baffle opposite from said second intermediate baffle, said muffler having a fluid communication path from said inlet to said outlet through said expansion chamber, said second of said tubes having a first region near said second end baffle and a second region within said expansion chamber, said second of said tubes in transverse cross section having a first perimeter surrounding a first area in said first region and a second perimeter surrounding a second area in said second region, said first perimeter divided by said first area forming a first ratio, said second perimeter divided by said second area forming a second ratio, said second ratio being larger than said first ratio, said housing wall in transverse cross section in and between said first and second regions surrounding a third area, said third area divided by said first area forming a third ratio, said third area divided by said second area forming a fourth ratio, said fourth ratio being larger than said third ratio;

whereby said relationships of said ratios provides increased sound attenuation.

4. A muffler in accordance with claim 3 wherein said second tube has a substantially constant perimeter at all locations along its length.

5. A muffler in accordance with claim 4 wherein said second region includes an inward deformation portion of said second tube, said deformation portion extending to an end of said second tube.

6. A muffler in accordance with claim 5 wherein said deformation portion includes means for reducing back pressure.

7. A muffler in accordance with claim 6 wherein said back pressure reducing means includes an outward flared portion at the end of said second tube.

8. A muffler in accordance with claim 7 wherein said deformation portion of siad second tube proceeds from a circular cross-sectional shape in a gradual decrease in cross-sectional area to a throat before expanding in said flare, said back pressure reducing means further including a perforated portion along said gradually decreasing portion.

* * * * *